US005136940A

United States Patent [19]

Olek et al.

[11] Patent Number: 5,136,940

[45] Date of Patent: Aug. 11, 1992

[54] AUXILIARY DRIVE FOR THE DUCTOR ROLLER OF A SHEET-FED OFFSET PRESS

[75] Inventors: Joachim Olek, Offenbach am Main; Heinrich Ochs, Sinntal; Kurt Difflipp, Dietzenbach, all of Fed. Rep. of Germany

[73] Assignee: MAN Roland Druckmaschinen AG, Fed. Rep. of Germany

[21] Appl. No.: 692,001

[22] Filed: Apr. 26, 1991

[30] Foreign Application Priority Data

Apr. 26, 1990 [DE] Fed. Rep. of Germany ..... 4013237

[51] Int. Cl.[5] ..... B41L 23/00; B41L 25/00

[52] U.S. Cl. ..... 101/148; 101/350; 101/363

[58] Field of Search ..... 101/350, 363, 349, 148

[56] References Cited

U.S. PATENT DOCUMENTS

| | | | |
|---|---|---|---|
| 1,785,158 | 12/1930 | Tornberg | 101/350 |
| 2,406,928 | 9/1946 | Taylor et al. | 101/350 |
| 3,098,437 | 7/1963 | Tyma, Jr. et al. | 101/350 |
| 3,170,397 | 2/1965 | Dutro et al. | 101/350 |
| 3,191,528 | 6/1965 | Jorgensen | 101/350 X |
| 3,590,735 | 7/1971 | Treff | 101/350 |
| 3,688,696 | 9/1972 | Treff | 101/350 |
| 4,007,683 | 2/1977 | Dickerson | 101/363 |

*Primary Examiner*—Edgar S. Burr
*Assistant Examiner*—Moshe I. Cohen
*Attorney, Agent, or Firm*—Leydig, Voit & Mayer

[57] ABSTRACT

An auxiliary drive for the ductor roller of a sheet-fed offset press continues to advance the ductor roller in small angular steps during press stoppages. The damping unit drive which continues to run during press stoppages drives the ductor roller stepwise by way of an eccentric drive linkage and a ratchet wheel disposed on the ductor roller journal. When the press is running, a rocker lever in the drive linkage can be pivoted away from the throw zone of the eccentric for example, by a piston actuated by oil pressure of the press's oil supply system. In alternative embodiments, the lever arm can be pivoted away by a compressed air cylinder or a suction cylinder which become operative when the press is running.

10 Claims, 3 Drawing Sheets

AUXILIARY DRIVE FOR THE DUCTOR ROLLER OF A SHEET-FED OFFSET PRESS

FIELD OF THE INVENTION

The present invention relates generally to sheet-fed offset printing presses and more particularly concerns an auxiliary drive for the ink ductor roller of such presses.

BACKGROUND OF THE INVENTION

In the inking units of offset presses, ink consumption is adjusted over ductor roller length by duct blades or metering elements as the ductor roller rotates in adjustable angular steps while the press is running.

A separate motor, transmission and control electronics are usually provided to drive the ductor roller of large offset presses. In small offset presses, however, the drive is often mechanical. For example, a shaft driven by the press drive may have a crankpin and a drive rod pivotally connected thereto for providing oscillatory movements which are correspondingly speed-dependent. The drive rod has its other end pivotally connected to a ratchet drive disposed on the input journal of the ductor roller and thus drives the ductor roller in angular steps. Examples of this are known in the prior art from DE-PS 1,000,400 and DE-Gbm 6,628,071, for example.

With arrangements of the foregoing type, when the press stops the ductor roller also stops. As a consequence, the ink, depending upon its thickness or thinness, would in time spill out through the gap between the duct blade or metering element and the ductor roller and thus soil parts of the press below. This problem can be obviated, however, if the ductor roller continues to be driven when the main press cylinders are stationary. A constant ink film is thus produced on the ductor roller so that spillage is prevented.

In large offset presses having an independent ductor roller drive, the drive merely needs to remain energized during press stoppages in order to continue to rotate the ductor in steps, for example. However, press stoppages must be covered by an independent drive in the case of small offset presses in which the ductor roller drive is derived from the main drive. Such an arrangement is disclosed, for example, in U.S. Pat. No. 4,007,683. As disclosed here, in the event of a press stoppage, an auxiliary drive in the form of a separate motor continues to drive the ductor roller. The auxiliary drive is connected via a ratchet wheel to the drive journal of the ductor roller so that when the press is running and the auxiliary drive is inoperative, the auxiliary drive is automatically cut out of operation. It is also known in the prior art, in cases where there are a number of printing units, to arrange for a number of ductor rollers to be driven by a single auxiliary motor, for example, by means of flexible shafts, when the press is not running.

A disadvantage of such solutions is that auxiliary motors must be provided just to drive the ductor roller during press stoppages. This runs directly contrary to one of the primary features of small offset presses wherein the outlay on drive technology is much less because the ductor roller is driven directly by rotation of the press.

OBJECTS AND SUMMARY OF THE INVENTION

It is therefore the primary aim of the present invention to provide a mechanically simple auxiliary drive for the ductor roller of a sheet-fed offset press which provides continuing stepwise rotation of the ductor roller during press stoppages and which is also brought into and out of operation automatically.

According to the present invention, the dampening unit drive, which continues to run during press stoppages, drives the ductor roller stepwise by way of an eccentric drive linkage and a ratchet wheel disposed on the ductor roller journal. When the press is running, a rocker lever in the drive linkage can be pivoted away from the throw zone of the eccentric for example, by a piston actuated by oil pressure of the press's oil supply system. In alternative embodiments, the lever arm can be pivoted away by a compressed air cylinder or a suction cylinder which becomes operative when the press is running.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
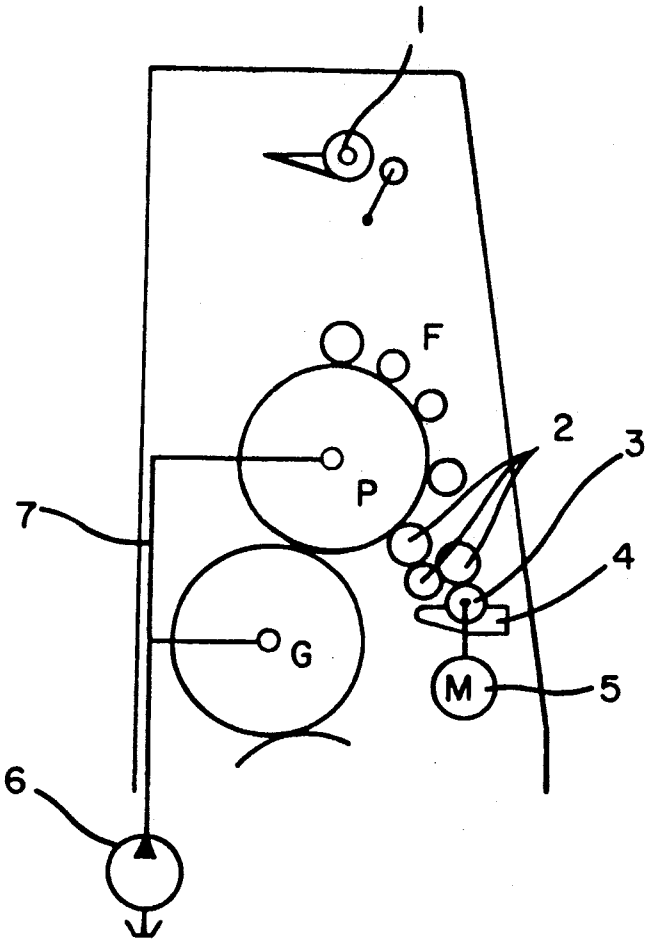
FIG. 1 is a schematic side view of a prior art press.

Turning now to the drawings, FIG. 1 shows a printing unit of a prior art offset press. As is known, for example, from DE-Gbm 8,628,071 and DE-PS 1,000,400, when the press is running a ductor roller 1 is rotated stepwise by way of a transmission. Ink therefore goes by way of a vibrator and other rollers (not shown) and inking rollers F to the printing plate clamped on a plate cylinder P. A dampening unit illustrated at 2–4 having an independent drive 5, is disposed before the inking unit, as considered in the direction of plate cylinder rotation, and supplies a film dampening fluid to the plate cylinder P. Such a film dampening unit having an independent drive is known, for example, from the book entitled "Offsetdrucktechnik", 6th Edition 1989, Fachschriftenverlag 7012 Fellbach, pages 437 ff.

As illustrated schematically in FIG. 1, scoop roller 3, whose speed can be continuously varied by an independent dampening unit drive 5, dips into a dampening agent tank 4 and delivers dampening agent to the other dampening rollers 2. Since an adjustable gap is provided between the roller 3 and a dampening unit roller 2 for dispensing purposes, a dampening unit of this kind can continue to be driven even when the press is stationary. Indeed, it is generally driven to ensure that a dampening film is always present on the scoop roller 3. Other dampening units in the prior art are also of use for the invention to be described hereinafter provided that they have a drive which can continue to operate during stoppages of the press.

To lubricate mechanical parts, such as the bearings of the printing unit cylinders, when the press is running, the press typically has an oil supply system which delivers oil under pressure to the corresponding lubrication stations. An oil pump 6 whose drive can be taken from the press main drive delivers oil through delivery lines 7 to the corresponding lubrication stations for example to the bearings of the plate cylinder P and blanket cylinder G, as shown in FIG. 1. Since the oil pump 6 is coupled with the press main drive, oil is delivered under pressure only when the press is running. Conversely, there is no oil under pressure in the oil lines 7 when the press is stationary.

In accordance with the present invention, the ductor roller 1 is driven from the dampening unit drive when the press is stationary. The ductor roller is rotatably mounted by means of journals at both ends in the press frame walls. As shown in the preferred embodiment illustrated in FIG. 2, a ratchet wheel 9 associated with a lever 10 is disposed at one end on the ductor roller input journal 8. It will be understood that the effective direction of rotation of the ratchet wheel 9 corresponds to the direction of rotation of the ductor 1, as indicated by the arrow. In accordance with normal practice another ratchet wheel is provided on the journal 8 to drive the ductor roller 1 when the press is in operation. Moreover as can be gathered from the publications hereinbefore referred to, this other ratchet wheel also drives the ductor roller 1 in a conventional stepwise manner.

Figure 2:
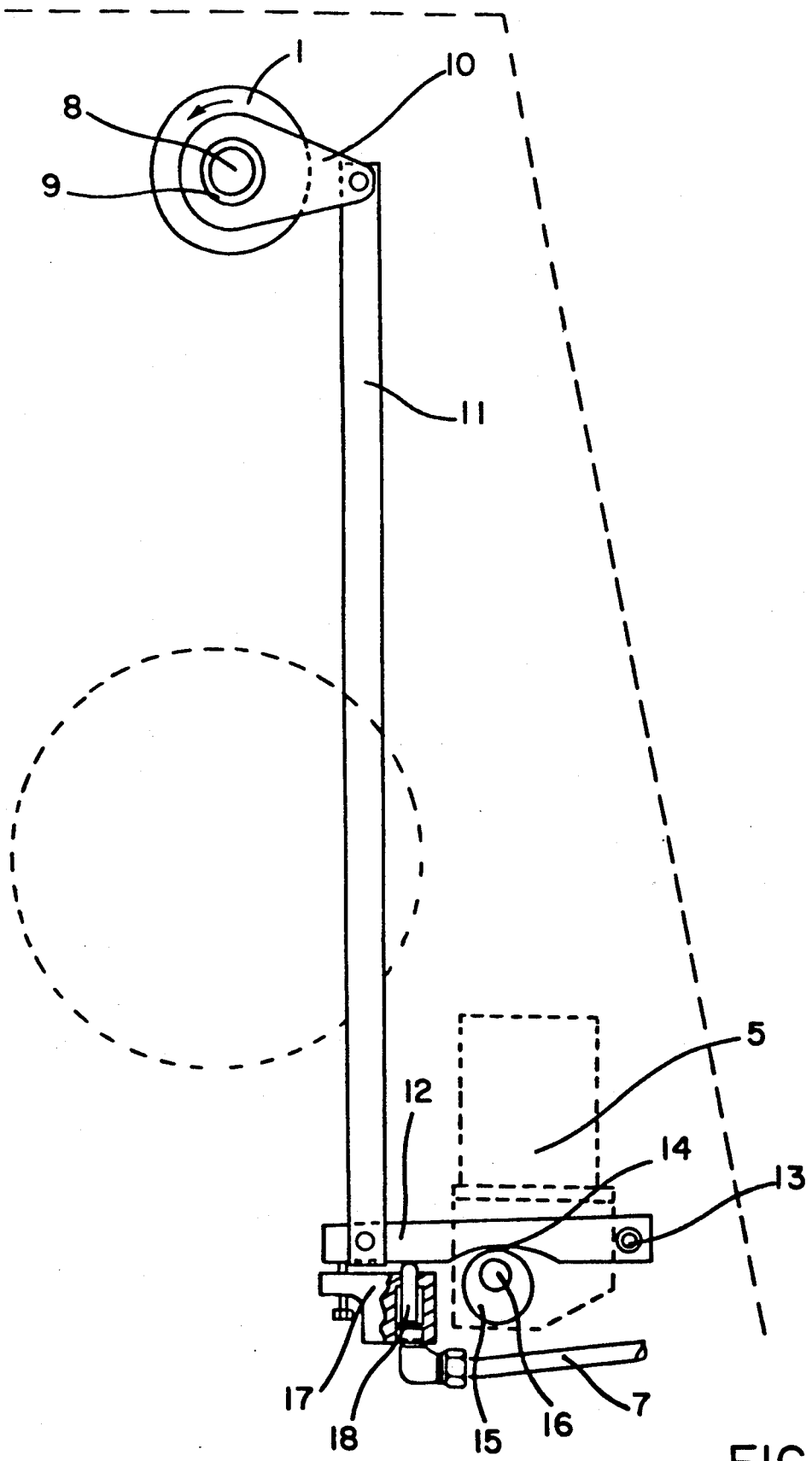
FIG. 2 is a side elevational view illustrating one embodiment of an auxiliary drive for a ductor roller according to the present invention; and FIGS. *3a–3e* illustrate various alternative embodiments.

Pursuant to the preferred embodiment of the invention shown in FIG. 2, a drive rod 11 has its bottom end pivotally connected to a rocker lever 12 mounted for rotation around a pin 13 rigidly secured to the press frame. The rod 11 is connected at its top end to the ratchet drive lever 10. When the press is not running an arcuate bearing surface 14 of the rocker 12 rests by its own weight, plus that of the rod 11 on an eccentric 15 disposed on a shaft 16 of drive 5 of the dampening unit. For convenience, the shaft 16 can be an elongated pin of the scoop roller 3 or a transmission shaft of the dampening unit drive 5, which runs at a relatively low speed. Advantageously, the eccentric 15 is journalled in an anti-friction-type roller, needle or ball bearings.

When the dampening unit drive 5 continues to run, while the press is stationary, the eccentric 15 acts by way of the rocker 12 to produce oscillating movements of the rod 11. These oscillating movements acting by way of the lever 10 and ratchet wheel 9 drive the ductor roller 1 in a stepwise manner. It will be appreciated that the speed at which the dampening unit drive 5 runs, while the press is stationary, can be preset and the dampening unit 5 can be connected to the press control in order to automatically continue to run at a predetermined reduced speed, for example.

According to the preferred embodiment described above, the rocker lever 12 rests by its own weight and the weight of the rod 11 and by way of the arcuate bearing surface 14 on the eccentric 15. Alternatively, various spring means which bias the rocker 12 on to the eccentric 15 when the press is stationary can also be provided.

Pursuant to another feature of the invention, means are provided to disconnect the auxiliary drive from the ductor roller 1, when the press is running normally or restarting to ensure that the ductor roller 1 is driven only from the conventional drive for the ductor. To this end, in the preferred embodiment a single-acting pressure cylinder having a piston 18 is provided and actuated by the oil pressure of the oil supply system of the press. This cylinder can be disposed, for example, in a bridge 17 rigidly secured to the press frame. Consequently, when the press runs the oil pressure acting on the piston 18 can pivot the rocker lever 12 and its arcuate surface 14 away from the operative zone of the eccentric 15. The eccentric then rotates freely and, because of the ratchet wheel 9 is not oscillated, the ductor roller 1 can be driven only by its main drive.

Preferably, the stroke and lifting force of the piston 18 are such that even when oil pressure is low, as when the press runs slowly at starting, the stroke necessary to release the eccentric 15 is applied to the system formed by the rod 11 and rocker 12 against their weight. To this end, the single-acting pressure cylinder and piston in the bridge 17 may be energized with oil directly through an oil line 7 of the oil supply system of the press.

It will also be understood that if the oil pump 6 is not driven directly by the press main drive but, for example, by a separate electric motor, and if oil continues to be pumped when the press is stationary, pressure energization of the single-acting cylinder can be controlled by an electrically operated solenoid valve. The operating signals for the solenoid valves can be derived in a simple manner from the main drive or from the press control. The hydraulic energization is therefore controlled electrically when the press starts to run.

Figure 3A:
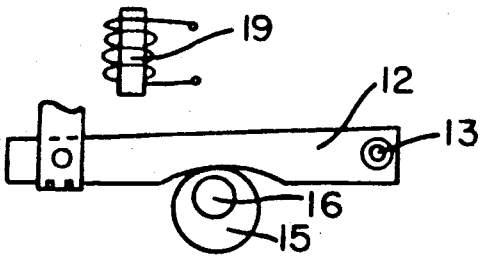

Instead of cutting the auxiliary drive into and out of operation by means of the oil pressure or electrically in association with the oil pressure of the oil supply system, the rocker lever 12 can be pivoted away by an electromagnet 19 as illustrated in FIG. 3*a*. Other actuating means 22 which come into operation when the press is running can be used. For example, compressed air for throwing the inking rollers F on and off by way of a single-acting pneumatic cylinder can be used if desired.

In a further alternative embodiment, suction type actuating means 22 can be used. In this case, the negative pressure can be provided from the suction air of the sheet feeder. In these suction actuated arrangements the cut-out of the auxiliary drive is also advantageously effected in association with electrically operated valves.

In the preferred embodiment of FIG. 2, as previously described, the auxiliary drive is driven by an eccentric 15 disposed on the dampening unit drive 5 and includes a lever 10, drive rod 11 and rocker lever 12 arranged as a quadrilateral linkage. The rocker lever 12 should be so designed that the throw of the eccentric 15 is transmitted to the rise of the rod 11 with a sufficient force. It should be further understood, of course, that it is possible by means of the quadrilateral linkage in association with the eccentric 15 driven by the drive 5 to provide an auxiliary drive for a ductor roller 1 when the ductor roller is not disposed substantially vertically above the dampening unit. Unlike what is shown in FIG. 2, the rod 11 need not extend vertically but can of course be at an inclination to the vertical. It is then possible to drive a ductor roller 1 which is disposed further from the dampening unit drive 5 in the horizontal direction.

Figure 3B:
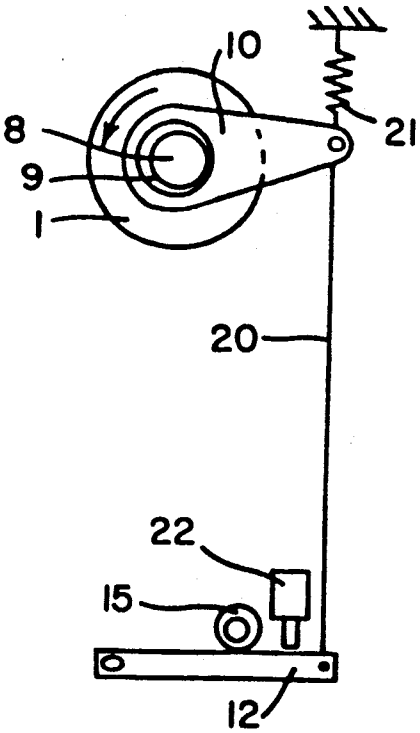

Other alternative embodiments of the invention are illustrated in FIGS. 3*b*–3*e*. FIG. 3*b* shows a spring-biased variant for using the dampening unit drive 5 to provide an auxiliary drive of the ductor roller 1. In FIG. 3*b* the rocker lever 12 is disposed below the eccentric 15 and has its free end connected by way of a pull rope, cable or the like 20 to the lever 10 which as previously described, is associated with a ratchet wheel 9 disposed on the ductor roller input journal 8. According to this embodiment, the link 20 can be a simple wire rope or a chain. A tension spring 21, pivotally but non-movably secured to the frame, pulls the lever 10 in the drive direction of the ductor roller 1. The throw movements of the eccentric 15 expand the spring 21 periodically as the spring biases the rocker 12 against the eccentric 15. In this variant the ductor roller 1 is moved by the contraction of the spring 21. The necessary spring energy is stored by the expansion of the tension spring 21 generated by the throw of the eccentric. The rocker lever 12 is pivoted away when the press is running by actuating means 22 which, as in the case of the prior embodiment, can take the form of a single-acting hydraulic cylinder, compressed air or suction air cylinder, or an electromagnet.

Figure 3C:
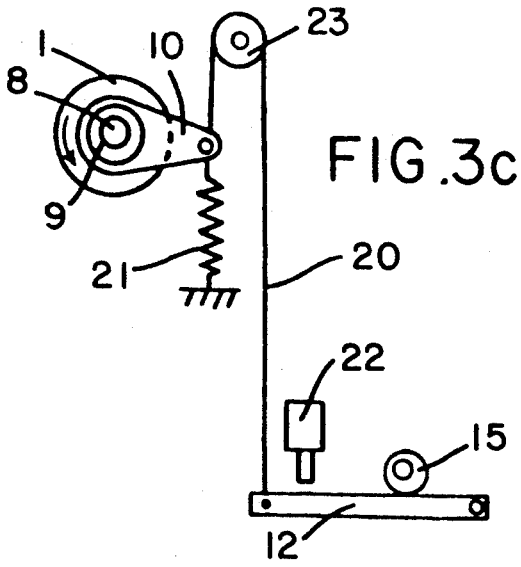

FIG. 3*c* shows another variant for using the dampening unit drive 5 to provide an auxiliary drive of the ductor roller 1. This arrangement has an equivalent effect to the arrangement shown in FIG. 3*b* except that in FIG. 3*c* the throw of the eccentric 15—i.e., of the free end of the rocker lever 12—produces the movement of the ductor roller 1 directly. In FIG. 3*c* the tension spring 12 pulls the lever 10 in the freewheeling (not power-transmitting) direction of the ratchet wheel 9. This is achieved by a reversing roller 23.

Figure 3D:
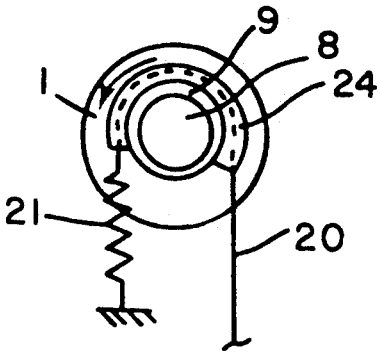
Figure 3E:
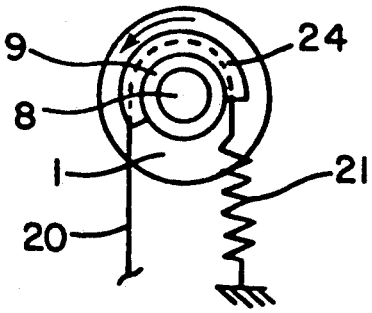

Instead of the lever 10, the rope 20 can be pivotally connected directly to a roller 24 disposed with the ratchet 9 on the ductor roller input journal 8, as shown in FIGS. 3*d* and 3*e*. It will be understood that the embodiment of FIG. 3*d* corresponds in effect to the embodiment of FIG. 3*b* and the embodiment of FIG. 3*e* corresponds in effect to that of FIG. 3*c*.

From the foregoing discussion, it will be understood that the primary advantage of the invention resides in the simplicity of the auxiliary ductor drive which cuts in automatically when the press stops. When the press stops, the dampening unit drive 5 becomes responsible for driving the ductor roller 1 without any substantial expense in modifying the drive technology being required.

We claim as our invention:

1. An auxiliary drive for the ductor roller of an offset press having a dampening unit with a separate dampening unit drive including a shaft, controllable independently of whether or not the press drive is running, comprising, in combination, a ratchet drive mounted on the ductor roller, an eccentric mounted on the shaft of the dampening unit drive, linkage means for transmitting oscillating motion from the eccentric to the ratchet drive when the press drive is not running, and means for disabling the linkage means when the press is running.

2. An auxiliary drive according to claim 1 wherein said linkage means includes a rocker lever pivoted on the press frame and engageable with said eccentric, a drive link interconnecting said lever and said ratchet drive for transmitting said oscillating motion thereto, and said disabling means is operative to swing said rocker lever out of engagement with said eccentric when the press is running.

3. An auxiliary drive according to claim 2 including spring means for biasing said rocker lever into engagement with said eccentric.

4. An auxiliary drive according to claim 3 wherein said rocker lever is mounted below said eccentric, said drive link includes a cable, and said spring means acting through said cable urges said rocker lever into engagement with said eccentric.

5. An auxiliary drive according to claim 4 including a reversing roller over which said cable is trained for changing the direction thereof.

6. An auxiliary drive according to claim 1 wherein said eccentric is mounted on an elongation of the shaft extending from the dampening unit drive.

7. An auxiliary drive according to claim 2 wherein said disabling means includes a fluid pressure cylinder having a piston operative when energized to swing said rocker lever out of engagement with said eccentric.

8. An auxiliary drive according to claim 7 wherein said cylinder is actuated by the oil pressure of an oil supply system of the press.

9. An auxiliary drive according to claim 1 wherein said disabling means includes electromagnetic means.

10. An auxiliary drive according to claim 1 wherein said disabling means includes a fluid pressure cylinder.

* * * * *